US006295780B1

(12) United States Patent
Thompson

(10) Patent No.: US 6,295,780 B1
(45) Date of Patent: Oct. 2, 2001

(54) SHEATHING TIE DOWN

(76) Inventor: Thomas Thompson, 92-543 Kokole Pl., Makakilo, HI (US) 96707

( * ) Notice: Subject to any disclaimer, the term of this patent is extended or adjusted under 35 U.S.C. 154(b) by 0 days.

(21) Appl. No.: 09/227,059

(22) Filed: Jan. 7, 1999

(51) Int. Cl.[7] ..... E04B 1/38

(52) U.S. Cl. ..... 52/712; 52/702; 52/714; 52/715

(58) Field of Search ..... 52/702, 712, 714, 52/715

(56) References Cited

U.S. PATENT DOCUMENTS

| | | | | |
|---|---|---|---|---|
| 3,696,571 | | 10/1972 | Schluter . | |
| 3,889,441 | * | 6/1975 | Fortine | 52/715 |
| 4,246,736 | | 1/1981 | Kovar et al. . | |
| 4,726,165 | * | 2/1988 | Brinsa | 52/714 |
| 4,896,985 | | 1/1990 | Commins . | |
| 4,976,085 | * | 12/1990 | Krueger | 52/715 |
| 5,150,553 | * | 9/1992 | Commins | 52/712 |
| 5,390,460 | | 2/1995 | Liorens . | |
| 5,423,156 | | 6/1995 | Hellessen, Jr. . | |
| 5,560,156 | * | 10/1996 | McDonald | 52/715 |
| 5,595,031 | * | 1/1997 | Commins | 52/712 |
| 5,653,079 | * | 8/1997 | Loeffler | 52/715 |

* cited by examiner

*Primary Examiner*—Carl D. Friedman
*Assistant Examiner*—Kevin McDermott

(57) ABSTRACT

A metal connector that securely ties together sheathing and the underlying structural members on a wood frame house. The connector correctly spaces each adjoining sheet with a slight gap to avoid buckling. The connector has a large surface area above the sheathing with precise nailholes to avoid sheathing splitting and assuring correct attachment to the underlying structural member. The connector can be used on roofs, walls, and floors. The connector grasps the sheathing and wraps around structural members to avoid detachment during hurricanes. The connector fashions sheathing into strong shearwalls to avoid building damage during earthquakes.

5 Claims, 14 Drawing Sheets

SHEATHING TIE DOWN

BACKGROUND

1. Field of Invention

This invention relates to an innovative connector that positively holds down sheathing to create buildings that are stronger and more resistant to earthquakes, hurricanes, tornadoes, and strong winds.

2. Description of Prior Art

Background

Recent studies of hurricane damage on wood-frame buildings indicate that the most extensive destruction to a house by strong winds, was when the roof sheathing was torn off and rain ruined everything in the house.

Roof sheathing ties all the rafters together on a wood frame house, and the roof sheathing ties all the roof trusses together when a masonry or wood-frame house is constructed with trusses. The roof sheathing helps prevent the trusses from racking, or tilting perpendicular to their length.

Sheathing that is tightly secured to the roof and subsequently fastened to the walls, helps transfer uplifting forces to the walls and henceforth to the foundation. If the roof sheathing fails, the trusses collapse, and the walls usually fall down as they can not stand by themselves against strong winds.

Failure and loss of the roof sheathing is common during hurricanes, mainly because of inadequate fastening of the roof sheathing to the underlying structural members. The roof system provides stability to a house by bracing the tops of exterior and interior load-bearing walls.

Sheet metal joints perform better than nailed joints in high winds and during seismic activity. Strong connectors, secured by well placed fasteners, will insure that the major structural members of a house are securely tied together.

Hurricanes

Studies of damage after Hurricane Andrew show several problems with the attachment of roof sheathing that this invention solves. Some sheets of roof sheathing that were blown off houses contained no nailholes, indicating that the sheet was placed in position, but was not nailed down. Some roofing sheets had nails in them that had missed the rafter that they should have been nailed upon. Some sheets had staples or nails that had rusted away, and on some sheets the nails had just pulled out from the rafter.

The engineering staff of the American Plywood Association provided technical personnel to assess the damage from Hurricane Andrew in Florida. The majority of wood structural sheathing failures were attributed to improper connection details, and in every case investigated, the sheathing loss was a result of improper nailing (Keith, 1992).

These problems have not been solved because staples are still used to tie down roof sheathing, and by looking at new construction, nails are still seen poking through the roof sheathing, completely missing the roof rafter. Most conscientious framers would drive another nail when they felt the nail miss the underlying rafter, but with the new powered nail guns, the framer can not tell if the rafter was missed because each shot feels the same, no matter what the nail is being driven into.

Earthquakes

During an earthquake, the floor, wall, and roof diaphragms undergo shearing and bending. The shear forces from the roof boundary members are transferred to the top of the shear wall by way of toenails or blocking to the top plate. To withstand and transfer the shear loads, plywood sheets have to be spliced together to prevent adjoining edges from sliding past or over each other (Gray, 1990).

Butted together on the centerline of a 2 by (nominally 1½-inches-wide), you've only got ¾ inch bearing for each plywood sheet, so the nail has to be ⅜ inch from the edge. This leaves little margin for error, and nailing has to be done with care to avoid splitting the plywood and missing or splitting the underlying member (Gray, 1990).

Tests at the University of California show that plywood secured by overdriven nails, nails that penetrated the plywood beyond the first veneer (usually by a powered nailgun), failed suddenly and at loads far below those carried by correctly nailed plywood panels (Gray, 1990).

Steel connectors, between different components of a wood-frame building's superstructure, provide continuity so that the building will move as a unit in response to seismic activity (Yanev, 1974).

Prior Art

A number of connectors have been developed to tie together the structural members of a house under construction. Up until this invention, nobody had seen how to make a compact connector that could tie two or more sheathing sheets together and to the underlying structural members, or could be applied from the top of the roof.

Some prior art prevents uplift, but this invention not only prevents uplift during hurricane-force winds, but prevents lateral movement during earthquakes.

The Simpson Strong-Tie Co.'s January 1996 catalog (page 62) lists a PSCL Plywood Sheathing Clip. This clip provides a gap and aligns sheathing but does not tie the sheathing to underlying structural members or prevent uplift or lateral movement. No other sheathing ties were found in their catalog, but they do show several seismic and hurricane ties on pages 60–61.

Several of their ties "neck down" at right angle bends. The H2, H2.5, H3, H4, H5, and H7 become narrower at their right angle bends. This is also seen on the flat pattern layout for the H4 and H5 on U.S. Pat. No. 4,714,372 by Commins. The "notch effect" shown in this patent is also avoided on my invention because of the smooth bends and edges.

A prior art roof securing system by Llorens, U.S. Pat. No. 5,390,460 ties down a single sheet of roof sheathing to a support beam. This is a good connector, but it is long, and can only tie down one-size of sheathing. It must be hammered around the beam from below, but panels are installed from above the roof. Llorens' 460 can only tie down one panel and provides little lateral support.

Another sheathing strap and alignment guide by Nellessen, U.S. Pat. No. 5,423,156 shows an apparatus for securing sheathing using a long strap, connecting bands, and saddles. This is a good connector, but it is long, complicated, and must be installed from below the roof. With sheathing in place, this is difficult. Nellessen's 156 can only tie down panels of one size.

According to the magazine Fine Homebuilding, October/November, 1998, sheathing courses should begin with either a full or half sheet. The course of sheathing at the top row and beginning row are often odd-size, in order to get a reasonable width of sheathing on the top row.

OBJECTS AND ADVANTAGES

Accordingly, several objects and advantages of my invention are that it helps secure the roof, wall, and floor of a building to keep the building from being destroyed by hurricanes, tornadoes, and earthquakes.

This invention helps prevent the wall of a building from detaching from the wall studs during a hurricane or earthquake. It makes the wall into a stable shearwall, transferring shear forces into the foundation and ground.

This invention helps prevent the roof of a building from detaching from the rafters or roof trusses during a hurricane. It ties the roof sheathing securely to the underlying rafter or roof trusses, transferring lateral and uplift forces to the walls and to the foundation.

This invention helps prevent the floor of a building from detaching from the floor joists during an earthquake. It makes the floor into a horizontal shear wall, and helps the floor resist lateral forces in its horizontal plane. It also makes sure that any forces transferred from the roof and wall can be managed by the floor and transferred properly to the ground.

One object of this invention is to make each plywood structure on a house into a shearwall, that is, able to transfer forces without breaking or disconnecting. By tying the plywood securely to the underlying structural member, the plywood can reliably transfer and dissipate shear, lateral, and uplift forces to the ground.

During an earthquake or a hurricane, another object is for the building with my invention to move as a sturdy unit, resisting and transferring destructive forces to the ground. Mounted on the roof sheathing and rafter, my invention resists uplift, the most destructive force during a hurricane. Mounted on the wall stud and wall sheathing, my invention prevents the wall sheathing from being blown off or sucked out by the extreme negative pressure of a hurricane. Mounted on the floor sheathing and floor joists, my invention prevents the floor from separating, if it should get wet during a hurricane.

During an earthquake, when my invention is mounted on the roof, walls, and floors, they will turn each member into a shear wall. The secured plywood will absorb and dissipate earth movements, without becoming detached from the underlying structural members. It will also prevent the sheathing from sliding over or past each other.

This could improve a house to existing building codes, as sheet metal joints have been proven to perform better than nailed joints during hurricanes and earthquakes.

Another object of this invention is the large surface area on the top or outside part of the sheathing. This area prevents the plywood sheathing from splitting during nailing. The large surface area provides more strength in the connecting or hold-down process.

Still another advantage is the accurately placed nailholes on the invention. These nailholes prevent nails from splitting the plywood or underlying rafter, stud, or joist, by making the framer place nails at the correct and accurate location.

Another advantage is that the invention prevents overdriven nails from penetrating the fragile outer veneer of the plywood sheathing. The accurately placed nailholes prevent the nailhead from piercing the outer veneer of the plywood.

Another advantage is that some nails, on the invention, are driven into the strong broad side of a rafter, stud, or joist. The invention also wraps around each structural member, forming a very strong connection to the sheathing, preventing the nails from pulling out.

Yet another advantage of this invention is during earthquakes, nails can sometimes bend with the movements of the house, but screws often break. Even though screws hold tighter than nails and provide a tight connection against uplifting forces from hurricanes, they are less resistant against earth movements. This invention absorbs and transmits most of the forces during an earthquake and hurricane so nails and/or screws can be used as fasteners.

Another advantage is that since the invention absorbs and transfers earthquake and hurricane forces, less nails and nailing could be used. Also, screws could be used in the invention in earthquake areas with less fear that the heads will shear off.

Still another advantage of the invention is in the ability to prevent plywood sheets from sliding past or over each other during an earthquake. Previously, only nails had to shear, but this entire connector must be sheared for the plywood to slide.

Another advantage is that plywood panels should not be butt together tightly or they may buckle when they expand due to heat or humidity. A slight gap should be left between panels. This invention provides a slight gap between each plywood panel that the invention is installed upon.

Still another advantage is that with the roof sheathing firmly attached to the rafters, roofing material will have a better chance of staying on during strong winds and earth movements. In addition, with the sheathing firmly connected, new materials may be attached to the roof, such as solar electric panels, without fear of them being blown off.

In areas with brush or forest fire danger, fire-proof material or heavy material, such as tile, stone or metal, can be applied to the roof with less danger of being blown or shaken off during earth tremors or high winds.

When the invention is applied to the studs and wall sheathing, fire-proof materials such as stucco or brick veneer can be applied to the sheathing with less chance of being shaken off during earth movements.

When the invention is applied to the floor joists and floor sheathing, the interior load-bearing walls can have a horizontal shear wall, inside the house, to help transfer earth movements.

Earth tremors and hurricanes always destroy the weakest parts of a house. By making each envelope of a house, the vertical walls, horizontal floors, and roof envelope into a strong unit, there will be less damage.

Another advantage is that the building contractor or a building inspector can visually inspect the roof sheathing, wall sheathing, and flooring for correct tie down, and can be assured that all the nails have been correctly placed. Previously, a visual inspection could not determine if the sheathing or flooring was properly applied and secured.

Still another advantage is that the invention can hold down standard-size or odd-size sheathing. According to Fine Homebuilding, October/November, 1998, sheathing courses should begin either with a full or half sheet. The course at the top row and beginning row are often odd-size, so that a reasonable width of sheathing is on the top row.

An advantage is that the framer can more accurately determine where the underlying structural member is located because the tie is on top of the sheathing, in line with the member.

Another advantage is the invention is easily used with current framing methods. The invention is installed from the top side of the sheathing so the framer doesn't have to go under the sheathing, which can be dangerous.

Nailguns can be used to attach this invention if the nail protrudes from the gun, prior to being driven. Nailguns can be used to apply nails to the sheathing and underlying rafter in-between the installed inventions, just like conventional construction. Screw guns can be used as well.

Still another advantage of this invention is when it is applied to the floor joist and floor sheathing, it will keep each sheet of sheathing a slight distance from each other helping prevent squeaks. Also, after a house is built, the wood floor joists and plywood shrink at different rates, causing gaps between them. By being tightly secured with my invention, any gaps will be insignificant, averting any squeaks.

Still another object is that the invention is thin so that a covering or underlayment can be easily applied. There is no "notch" effect where sharp corners or bends can cause stress points. All bends and edges are smooth, also, there is no "necking down" of the crossing member at right angle bends. The saddle and ribs are constant width for strength. An angled saddle would be necked down in order to offset the ribs.

It is a further object of this invention that it easily, quickly, and economically protects houses from the destructive forces of earthquakes and hurricanes. It is a still further object that the connectors and fasteners are strong, attractive, permanent, functional, uncomplicated, simple to manufacture, easy to install, and economical. All of the embodiments can be made from a single sheet metal blank, without any welding. Nesting of the ties during manufacturing prevents wasted material.

A further object is that this invention can be used on various size sheathing, rafters, roof trusses, studs, wood or metal I-beams, truss joint, and glue-lams, all made from wood or metal. There may be insurance discounts for homeowners who have this invention installed on their houses.

Previously, architects, engineers, and builders did not know how important the attachment of plywood sheathing was to the roof, walls, and floors. It was thought that the weight of the roof would keep the sheathing attached during a storm. Prior to this invention, no thought had been given to the floor as a horizontal shear wall during an earthquake.

These and other objectives of the invention are achieved by simple and economical connectors that allow a builder to quickly and easily secure the weakest parts of a building against earth tremors and high winds.

Advantages of each will be discussed in the description. Further objects and advantages of my invention will become apparent from a consideration of the drawings and ensuing description.

REFERENCE NUMERALS

Figure 1:
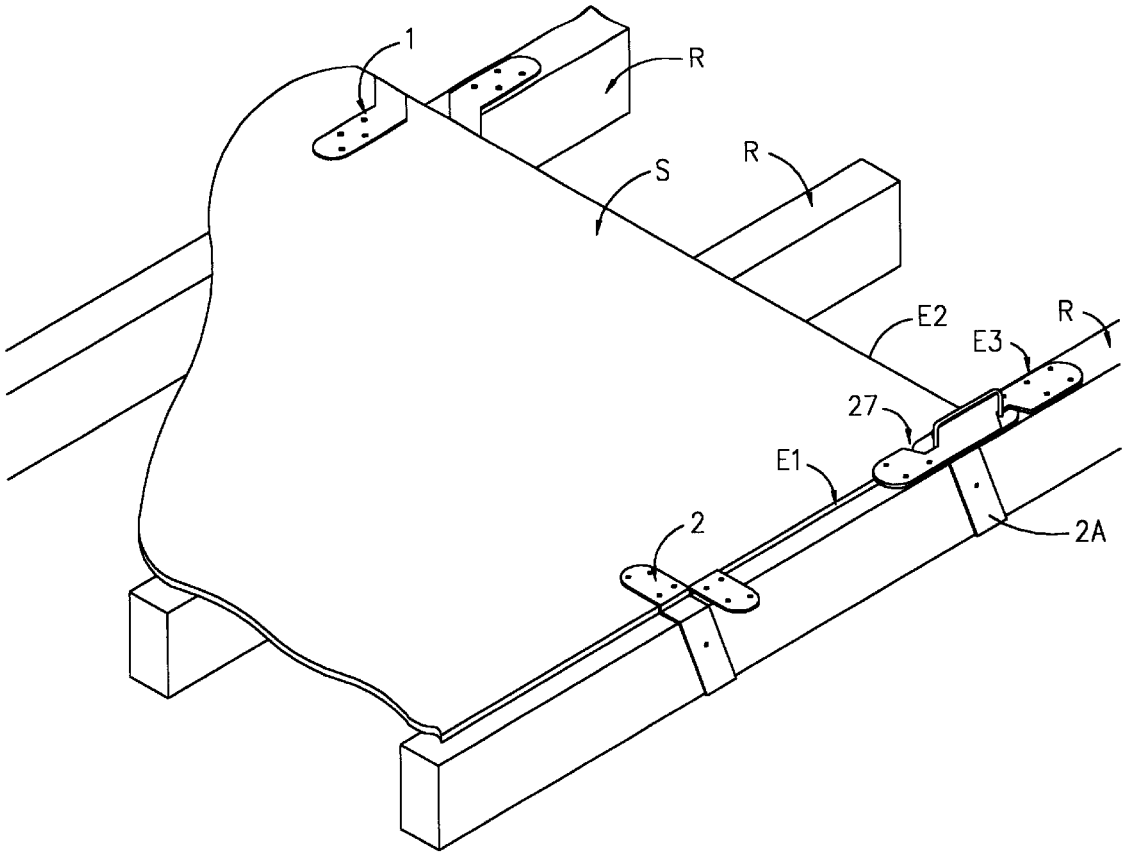
FIG. 1 shows the invention holding down sheathing.

1. Long tie
2. Edge tie
3. Saddle
3A. Left saddle bend
3B. Right saddle bend
3C. ½ left wing
4. Left wing
4A. Left traverse bend
5. Left tab
5A. Left cross bend
6. Left span
7. Right wing
7A. Right traverse bend
8. Right tab
8A. Upset
9. Right span
9A. Right cross bend
10A. Field nailholes
10B. Ample nailholes
10C. Centerline
11. Right trap
12. Left trap
13. Post saddle
13A. Left balanced bend
13B. Right balanced bend
14. Left stability rib
14A. Left step bend
14B. Contiguous nailholes
15. Right stability rib
15A. Right step bend
16. Left tread tab
16A. Left rung bend
17. Right tread tab
17A. Right rung bend
18. Left riser tab
18A. Left ascent bend
19. Right riser tab
19A. Right ascent bend
20. Left grasp
20A. Border nailholes
21. Right grasp
21A. Heath nailholes
22. ½ long tie
23. Wrap tie
24. Wire lock
25. Plate
26. Wire
27. Locking plate
28. ½ edge tie
29. Nailholes
30. Stop
31. Advanced tie
32. Prior art
R. Rafter
S. Sheathing

DESCRIPTION

FIG. 1

FIG. 1 shows the preferred location of the invention tieing down roof sheathing S on rafters R. This drawing could also be of the top chords in a roof truss, and roof sheathing; sub-flooring on floor joists; or outside sheathing on wall studs, since the invention can work in each location. When describing the rafter, the words "truss chord", "wall stud" and "floor joist" could be substituted, but for ease of writing and reading, this example will be of a rafter.

FIG. 1 shows two embodiments of the invention. Plywood sheathing is normally laid down so one edge is on the centerline of a rafter R, parallel to the rafter, and the adjacent edge spanning or crossing the rafters. FIG. 1 shows a long tie 1 securely tying down the sheathing S where it is spanning or crossing the underlying rafters R. An edge tie 2 is shown lashing down the sheathing edge, parallel to the length of a rafter R.

The bottom part of the invention wraps around the structural member and the top part of the invention cross over the member and holds down sheathing. Crossing over the opposite sheathing makes the sheathing to rafter connection very strong, and resistant to tension, shear, and torsion forces. Hurricane forces try to lift up the sheathing (tension) and twist the sheathing (torsion). Earthquake forces try to slide one sheet of sheathing over another (shear) and twist the sheathing (torsion).

Both the long tie 1 and edge tie 2 prevent the above forces from ripping the sheathing from the underlying structural members, by wrapping around the member and sheathing. Each tie holds down more than one sheet of plywood, preventing the edges of the plywood from sliding past or over each other during earthquakes.

FIG. 2A

Figure 2A:
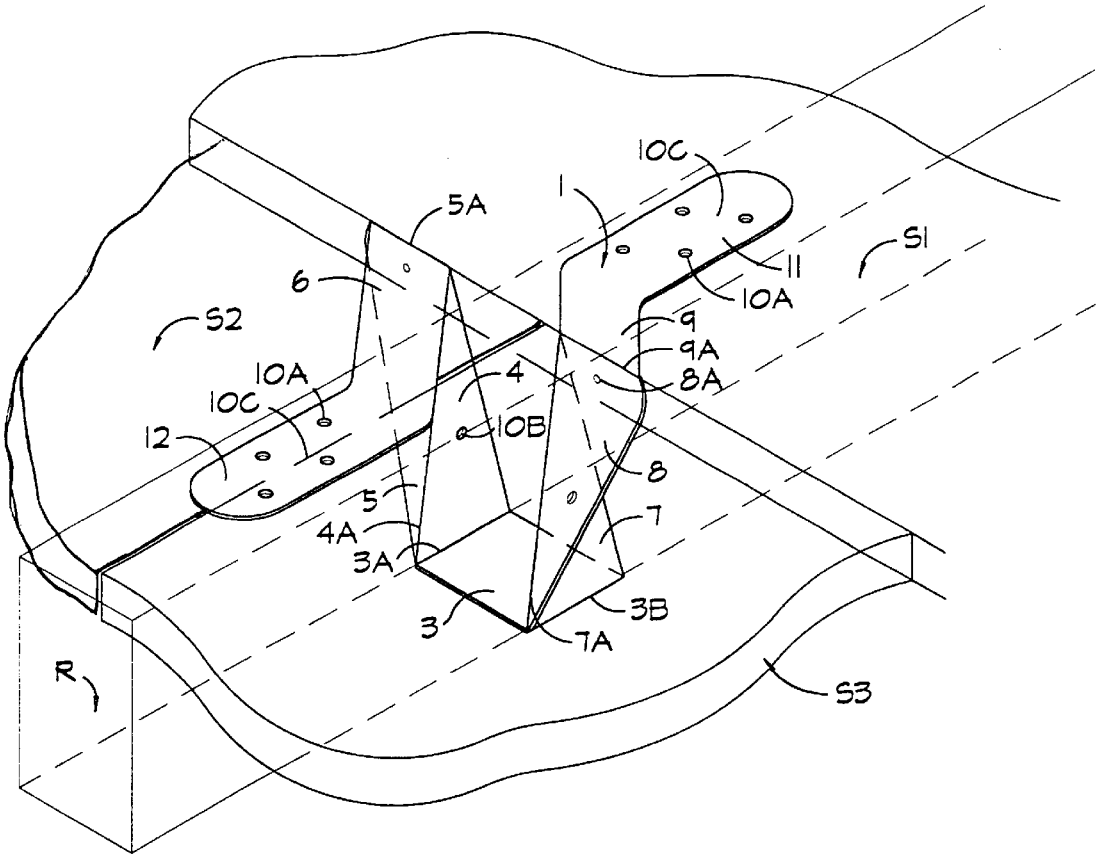
FIG. 2A is a perspective view of a long tie and sheathing.

FIG. 2A is a perspective view showing a long tie 1 tieing down three sheets of plywood sheathing. The plywood sheathing could be any material, such as oriented strand board, insulation board, or particle board. Staggering (see FIG. 6) the sheets of plywood is common, so five edges of three sheets of sheathing can meet on a rafter.

Sheathing sheets S1, S2, and S3 meet at the long tie 1. The sheet at S3 is cut away to show how the long tie 1 is attached to the rafter.

FIG. 2A shows how the long tie 1 is fashioned and used. The unitary metal body 3 wraps under the narrow edge of a rafter R. Right angle bends at the right saddle bend 3B and the left saddle bend 3A wraps the first side rib 7 and second side rib 4 respectively, along the wide dimension of the rafter.

The ample nailholes 10B are in slightly different locations on the first side rib 7 and second side rib 4, so that driven nails are not exactly opposite each other or in the same plane. Hence, the nails will not split the rafter or hit each other. Nails driven through ample nailholes 10B, and the wrapping of the saddle 3 around the rafter R, tie the long tie 1 to the rafter R.

A right angle bend at the right traverse bend 7A, forms the first offset 8. A right angle bend at the left traverse bend 4A forms the second offset 5. The first offset 8 and second offset 5 are stabilizing strength ribs that prevent lateral or rocking motion.

A right angle bend at the right cross bend 9A and the left cross bend 5A form the right span 9 and left span 6 respectively. Since the spans 9 and 6 are perpendicular to the rafter, they help prevent the sheathing from twisting due to lateral and shear forces. They also help make the roof into a shear wall, transferring these forces into the wall and ground.

An extension off the right span 9, called the right trap 11, is parallel to the underlying rafter. An extension off the left span 6, called the left trap 12, is parallel to the underlying rafter. The traps 11 and 12 hold down sheathing and also help transfer earthquake and hurricane forces into the wall and ground.

In FIG. 2A, the right span 9 and right trap 11 cover a singular sheet of plywood S1, while the left span 6 and left trap 12 cover two sheets of plywood sheathing S2 and S3. The wide surface area of the right span 9 and right trap 11, and left span 6 and left trap 12, covers the important edges of the sheathing, spreading the load like a washer, preventing splitting of the sheathing.

Most 2×4's or 2×6's are only 1½-inches-wide. If two sheets of plywood are to be nailed along this rafter, there can only be ¾ inch of nailing space for each one. Optimally, a nail should be driven ⅜ inch from the edge. This will insure that the nail will not split the plywood, and that the nail will be in the nailing edge or "meat" of the underlying rafter.

If the nail is driven just ⅛ inch closer to the edge of the plywood, the nail may split the plywood. This nail will not properly hold down the plywood, making it prone to moving, sliding, squeaking, or uplift.

If the nail is driven just ⅛ inch further away from the edge of the plywood, the nail may split the edge of the underlying rafter or may miss the rafter entirely.

Mostly parallel to the long dimension of the left trap 11, are slightly staggered nailholes called field nailholes 10A. The field nailholes 10A are approximately 3/8 inch from the centerline of the underlying rafter.

Installing nails or screws into the field nailholes 10A, and through the sheathing, assures that the fasteners will be near the center of the rafter R, not on the weak edge. Since the field nailholes 10A are not in an exact line, they will avoid splitting the narrow rafter.

The right trap 12 also has the same field nailholes 10A, but they are also in an optimal position where two sheets of sheathing lie on the centerline of the rafter. In this case, nails driven into the field nailholes 10A will grab onto the optimal segment of the underlying sheathing S2 and S3, approximately ⅜ inch in from the edge of the plywood, without splitting the plywood. These nails will also be driven near the centerline of the rafter, avoiding the weak edge.

In FIG. 2A, if framers are installing a roof, from the left to the right, the long tie 1 can be spread apart slightly, by putting one's left hand on the left trap 12 and one's right hand on the right trap 11, and pulling out. In this manner the first side rib 7 and second side rib 4 will flare out so the unitary metal body 3 can be placed under the rafter R and pulled up. The left trap 12 would then be placed over the two sheathing sheets S2 and S3, and the other sheet of sheathing S1 would be placed down and under the right trap 11. Nails or screws would then be placed in the appropriate nailholes.

The metal of the traps 11 and 12 prevents nails from "overdriving" and penetrating the first layer of the underlying plywood. This makes for a strong fastener connection. The metal forms a "washer" or large surface area to prevent wood splitting and giving more surface area to help secure the roof sheathing, but is not thick enough to cause problems with the overlayment of roofing materials.

The correct spacing between the sheathing sheets S1 and S2 is formed by the first offset 8 and second offset 5. The correct spacing between sheathing sheets S2 and S3 is formed by an edge tie 2, described later. This spacing prevents the sheets from buckling, due to heat or humidity. Nailguns, nails or screws would fasten the rest of the sheathing according to standard building codes. The centerline 10C would help framers line up their nails and nailguns on the rafter between ties.

Prior to this invention, framers were not sure of how far the correct spacing should be between sheets of plywood, or even if there should be a spacing. The spacing will now be automatic when a long tie 1 and edge tie 2 are used together. An upset 8A, a small dimple, could be stamped at the factory to increase spacing.

If FIG. 2A was of a floor joist and overlying floor sheathing, the saddle 3 would still wrap under the joist, and the correct spacing between sheets would be formed by the first offset 8 and second offset 5.

This spacing between sheets prevents the floor sheathing from buckling and also prevents two adjacent sheets from rubbing up and down against each other. Tongue and groove plywood would reduce squeaking, but is seldom available, so standard plywood is normally used.

Most floors have an irritating squeak when two adjacent sheets of floor sheathing scrape against each other when stepped upon. This invention securely ties each adjacent sheet of plywood to each other, while leaving a slight gap, and to the underlying joist.

After a house is built, the joist and plywood shrink at different rates, sometimes causing a gap between the joist and sheathing. Movement across this gap will cause it to squeak. Simple nailing will not prevent a gap. The first offset 8 and second offset 5 will securely hold the sheathing to the joist, even if the woods shrink at different rates, preventing gaps and subsequent squeaks.

An edge tie 2, shown on FIG. 1, ties the edge of a sheet of sheathing S on to the edge of the underlying rafter R. The edge tie 2 is similar to the long tie 1, having numerous bends that strengthen the connection and wrap around the underlying rafter. The edge tie 2 is simple to make and use.

FIG. 2B

Figure 2B:
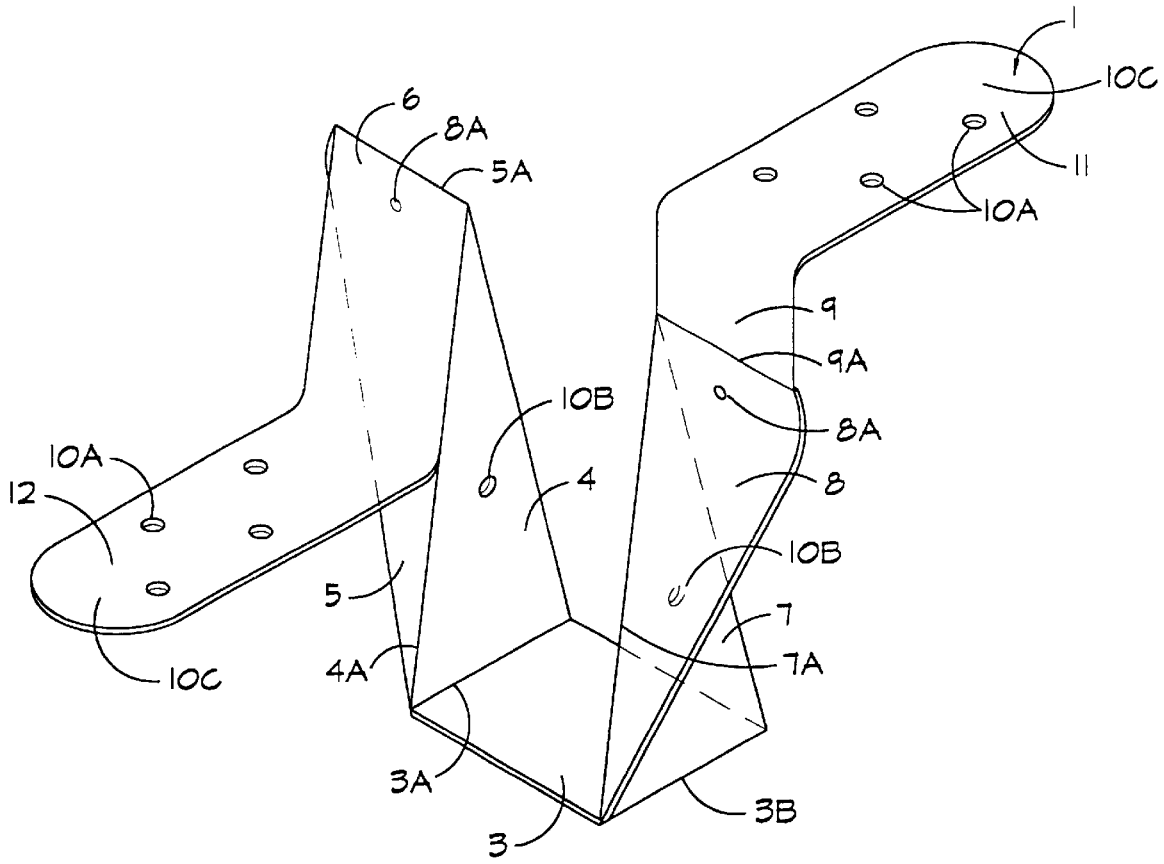
FIG. 2B is a perspective view of a long tie.

FIG. 2B shows a long tie 1 prior to being placed around a rafter. Although the long tie 1 is very strong, it gains the most strength when the right trap 11 and left trap 12 are nailed to sheathing and an underlying rafter, forming a strong box-like structure. As shown here, the top can be separated, hinging slightly at the right saddle bend 3B and the left saddle bend 3A, to wrap around a rafter.

FIG. 2B shows how the unitary metal body 3, the first side rib 7, second side rib 4, right span 9, and left span 6 form a strong box-like structure. The first offset 8 and second offset 5 are perpendicular to this formed box, preventing lateral movement. The right trap 11 and left trap 12 prevent uplift, and the left span 6 and right span 9 prevent racking of the sheathing.

FIG. 2C

Figure 2C:
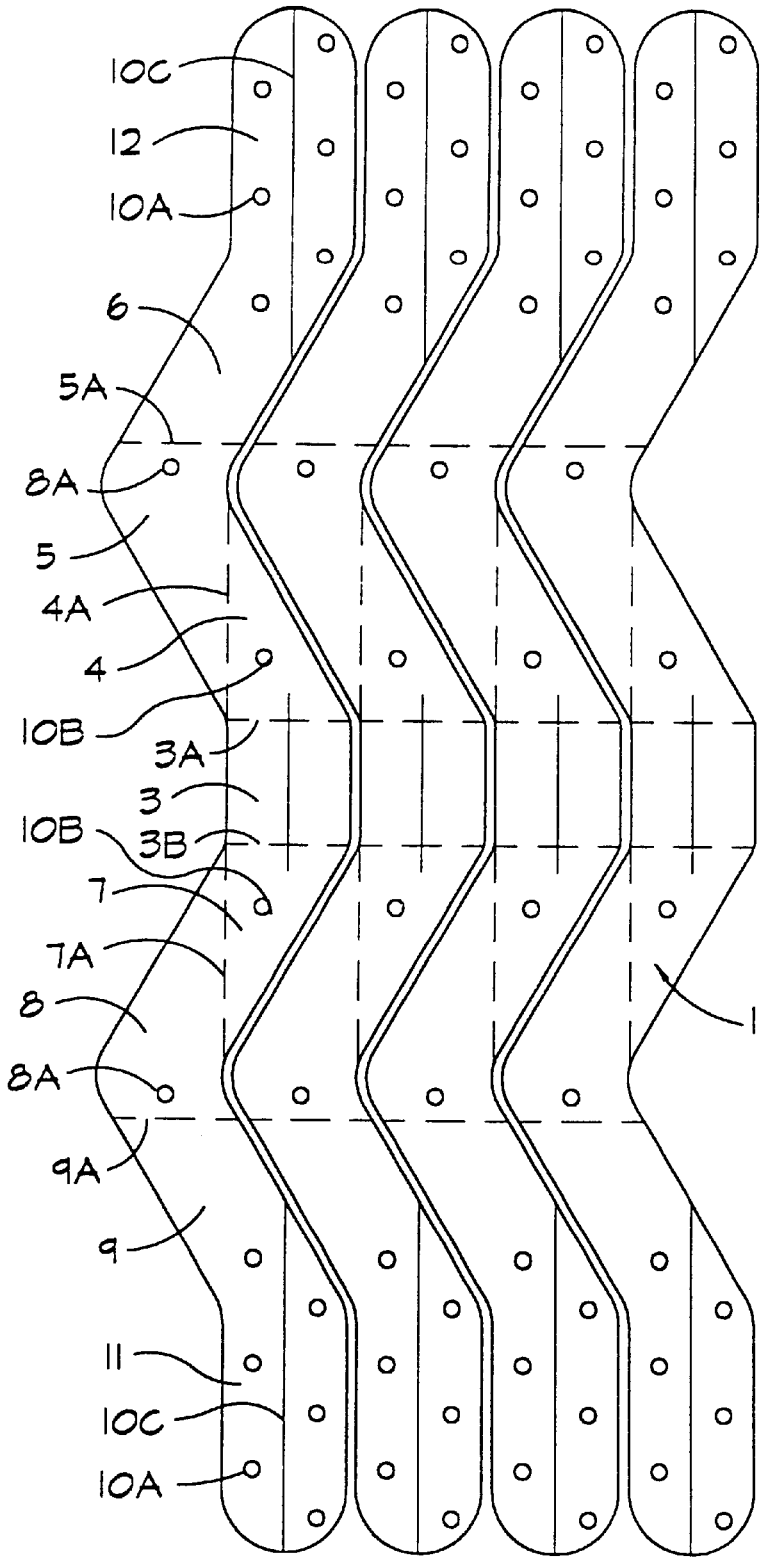
FIG. 2C is a flat pattern layout for a long tie.

FIG. 2C shows a flat pattern layout of a long tie 1 with all of the previously mentioned parts and bends labeled. The long tie 1 would be formed by simple tool and die methods of metal stamping and forming of bends.

FIG. 2C also shows how each long tie 1 "nests" with each other saving material and costs during manufacturing.

The long tie 1 could be formed with the left trap 12 and right trap 11 not bent at a right angle at the left and right cross bends 5A and 9A respectively.

With the traps 11 and 12 coming straight up, carpenters could bend down the traps over odd thickness sheathing. This would allow the long tie 1 to fit different dimension sheathing.

FIG. 3A

Figure 3A:
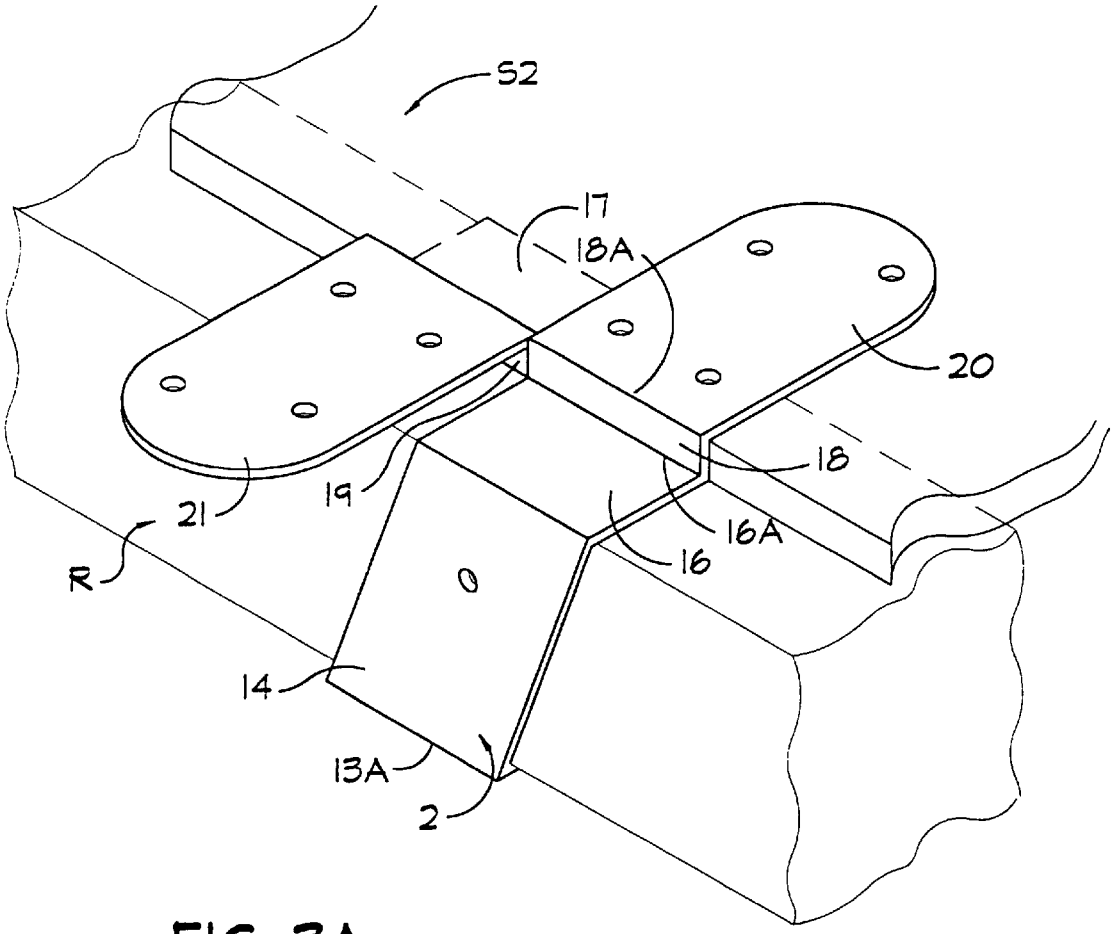
FIG. 3A is a perspective view of an edge tie and sheathing.

FIG. 3A shows an edge tie 2 securing a sheet of sheathing S2 to an underlying rafter R. A post saddle 13, wraps under the rafter R. Right angle bends at the left balance bend 13A and at the right balance bend 13B create the left stability rib 14 and right stability rib 15 respectively.

At the summit of the left stability rib 14 are right angle bends and tabs. At the top of the left stability rib 14 is a right angle bend, called the left step bend 14A, which serves to form a step around the rafter and on to the adjacent sheathing.

The left step bend 14A forms the left tread tab 16, which sits on top of the rafter R. A right angle bend at the left rung bend 16A forms the left riser tab 18, which spaces the plywood sheathing to prevent buckling.

A right angle bend at the left ascent bend 18A forms the left grasp 20 which secures plywood sheathing on the right. For clarity, the plywood sheet is not shown under the right grasp 21. The left grasp 20 contains border nailholes 20A, that are approximately ⅜ inch from the left ascent bend 18A. This arrangement of nailholes puts the fasteners at the optimal part of the plywood sheathing S2, without causing splitting of the sheathing, but also insures that the fastener travels into the underlying rafter without missing or splitting the edge of the rafter.

The angle of the left stability tab 14 and right stability tab 15 offset each tab so the left grasp 20 and right grasp 21 are separate from each other, and not directly opposite each other. The nails in the contiguous nailholes 14B will not be across from each other, or be in the same plane, helping to prevent splitting of the rafter.

Installation of the edge tie 2 is simple. By pulling the left grasp 20 to the right, and the right grasp 21 to the left, the tie will hinge slightly at the left and right balanced bends 13A and 13B respectively opening up and separating the left tread tab 16 and right tread tab 17.

In this manner, the post saddle 13 can be pulled up from below the rafter R and the left stability rib 14 and right stability rib 15 will be against the rafter. Nails can then be driven into the contiguous nailholes 14B, holding the edge tie 2 in position for the sheathing. The sheathing would then be slid into position and screwed or nailed down through border nailholes 20A and heath nailholes 21A.

The ties can be installed to the rafter before putting down the next row of sheathing, by wrapping the ties around the rafters and pulling them into position, next to the sheathing. Nails driven down through border nailholes 20A are correctly spaced to grip the optimum part of the sheathing and penetrate the "meat" of the rafter without splitting the plywood or rafter. The gap between the sheathing sheets S2 and S3 prevents the sheets from buckling, due to heat or humidity.

Nail guns can be used to attach this invention if the nail protrudes from the gun prior to being driven. Screw guns are almost as fast and will secure the invention better than nails.

FIG. 3B

Figure 3B:
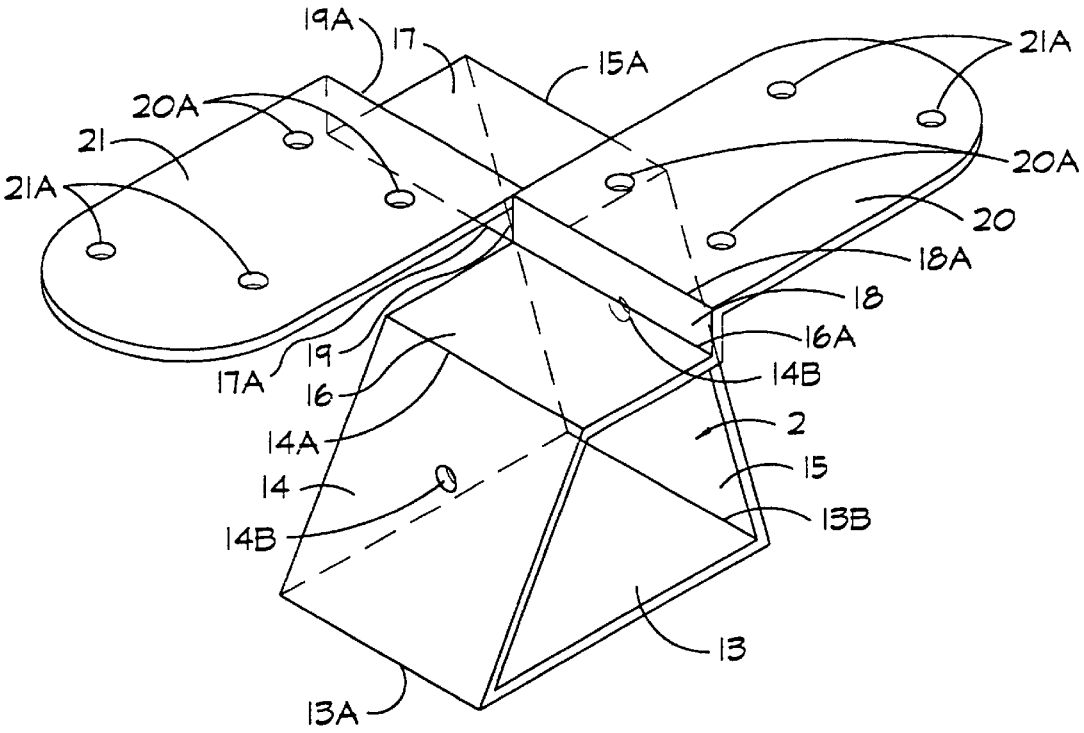
FIG. 3B is a perspective view of an edge tie.

FIG. 3B shows a perspective view of an edge tie 2 before being installed around a rafter. This view could also be a mirror image of FIG. 3A, showing how the left stability tab 14 and right stability tab 15 could be angled right. Most of the right side of the tie can be seen here that was hidden behind the rafter in FIG. 3A.

A right angled bend at the right balanced bend 13B, off the post saddle 13, forms the right stability rib 15. The parallelogram-shaped rib contains a contiguous nailhole 14B, for attachment to the side of a rafter. The saddle and ribs hold the sides and bottom of the tie securely to the rafter.

On top of the stability rib 15, a right angled bend, called the right step bend 15A, forms the right tread tab 17. This tab helps hold the top of the tie securely to the rafter. This tab also forms the correct distance, approximately ¾ inch, for the plywood sheet to rest against.

This space allows two plywood sheets to have the optimum span on the rafter without measuring. Ordinarily, a framer would measure or "eyeball" the measurement and gap, so that both adjacent sheets would have the same amount shouldered on the rafter.

Because of maneuvering, hammering, wind, mismeasurement, or warped rafters, one sheet might have 1 inch on the rafter, and the other sheet would only have ½ inch on the rafter. Many of the nails on this sheet would be misapplied. This error may continue down the line of sheathing installation.

Now a framer can just wrap an edge tie 2 around a rafter and slide the sheathing underneath. The gap between sheets would automatically be set by the left and right riser tabs 18 and 19, formed by the right angled bends at the left and right rung bends 16A and 17A respectively. The correct distance on the left and right tread tabs 16 and 17, would automatically set both sheathing sheets to have about ¾ inch on the underlying rafter.

A right angled bend at the right ascent bend 19A forms the right grasp 21. Border nailholes 20A, spaced at approximately ⅜ inch from the centerline of the rafter, would automatically be aligned at the correct location for proper nailing.

FIG. 3C

Figure 3C:
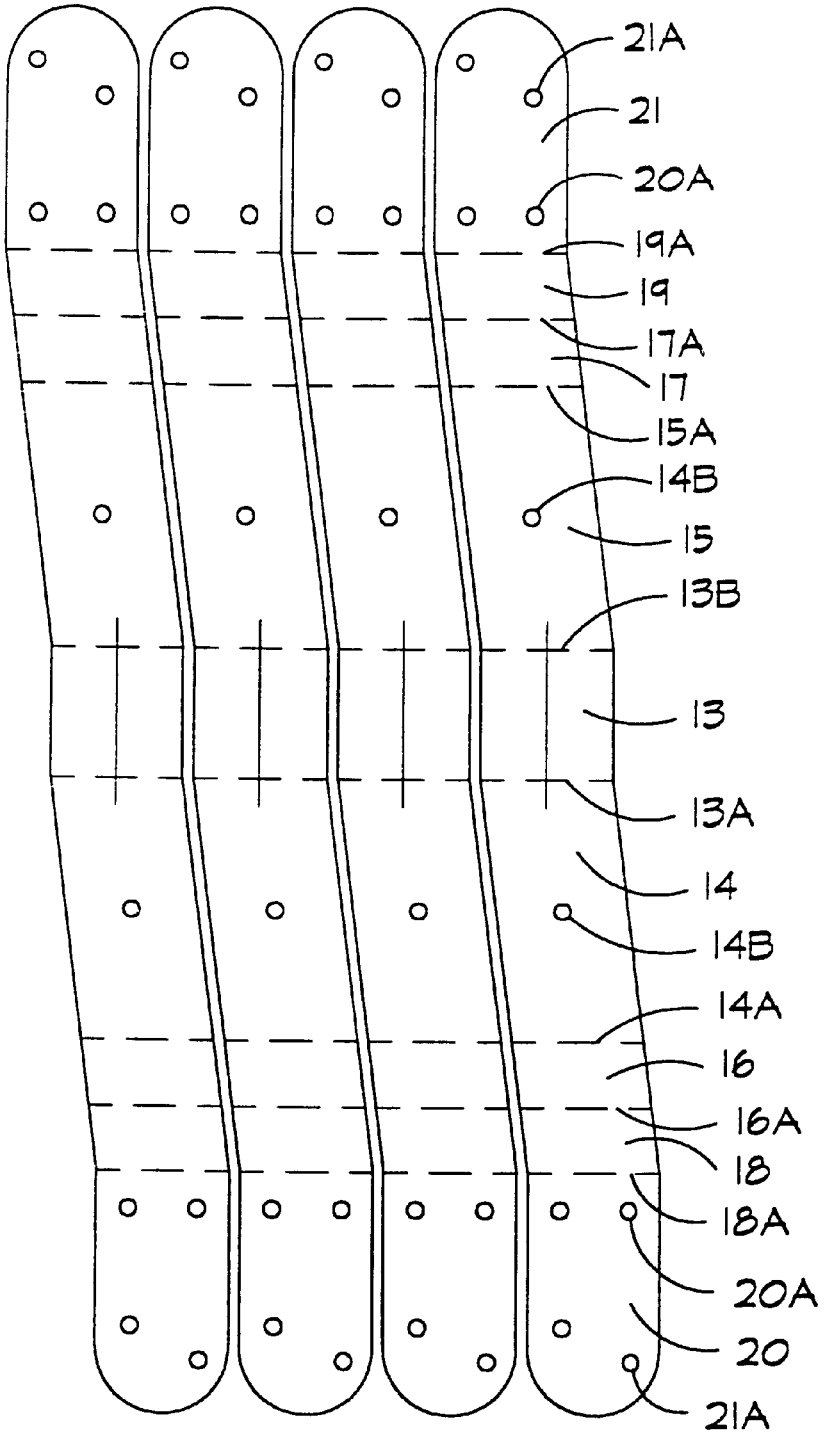
FIG. 3C is a flat pattern layout for an edge tie.

FIG. 3C shows a flat pattern layout of an edge tie 2 with all of the previously mentioned parts and bends labeled. The edge tie 2 can be formed by simple tool and die methods of metal stamping and forming of bends.

The edge tie 2 could be formed with the left grasp 20 and right grasp 21 not bent at a right angle at the left and right ascent bends 18A and 19A respectively.

With the grasps 20 and 21 coming straight up, carpenters could bend down the grasps over odd thickness sheathing. This would allow the edge tie 2 to fit different dimension sheathing.

FIG. 3C also shows how the edge tie 2 "nests" and will save material and costs during manufacturing.

Similar to how the ½ long tie 22 is formed, a narrower sheet could be fed into the tool and die to form a ½ edge tie 28. The sheet could be fed in from the left balanced bend 13A to the right grasp 21. The right balanced bend 13B would not be bent in a ½ edge tie 28 making the right stability rib 15 long and flat.

Similar to how the ½ long tie 22 works, the ½ edge tie 28 would have the long right stability rib 15 nailed to the long side of a 2×6, 2×8, or wider, or doubled-up 2×4's. Another ½ long tie 28 can be installed on the opposite side of the rafter increasing strength.

FIG. 4

Figure 4:
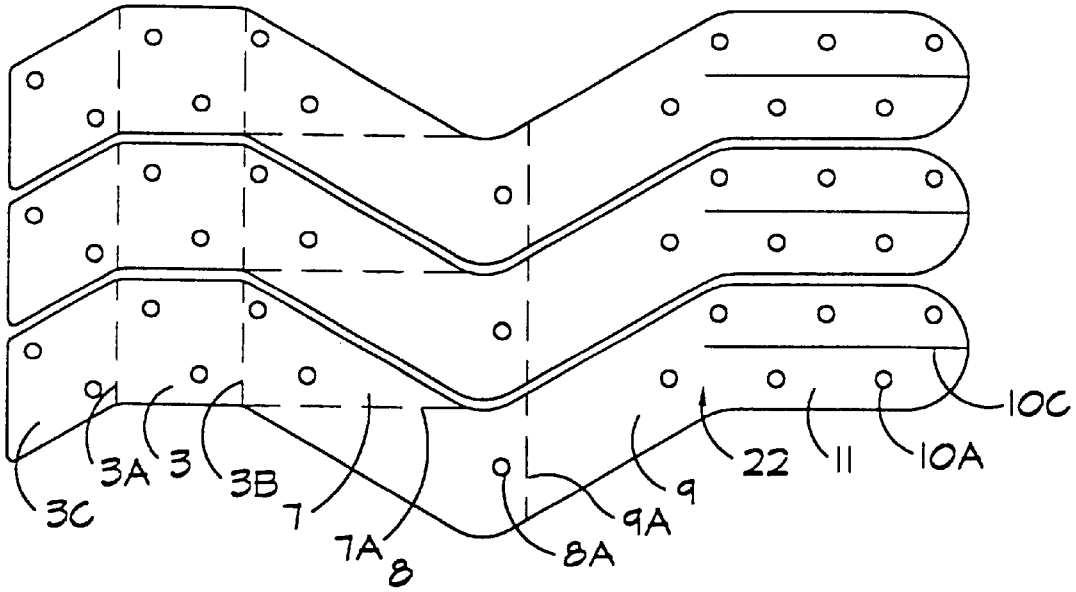
FIG. 4 is a flat pattern layout for a ½ edge tie.

Refer now to FIG. 4 which shows a flat pattern layout for a ½ long tie 22 formed from the same tool and die that makes a long tie 1. By running a narrower sheet in the die, FIG. 4 shows that this ½ long tie 22 has the right part of a long tie 1.

By having just one tab, the right trap 11, the ½ long tie 22 can be used on the lower edge of the first row of sheathing, without any cutting or hammering on a left trap 12. Otherwise, on the first row, the left trap 12 would be sticking out if a long tie 1 were used in this location.

The unitary metal body 3 would still be under the rafter. The first side rib 7 would be on one side of the rafter and the ½ second side rib 3C would be nailed to the opposite side. This would secure the leading edge of sheathing against uplift and lateral movement.

The ½ long tie 22 has other advantages as it can be used in other locations. Sometimes rafters are doubled up for strength; some post-and-beam type of houses use large timbers; and some house are constructed with rafters of different widths, such as 2×4's, 2×6's, and 2×8's.

By not bending the left saddle bend 3A or right saddle bend 3B, the first side rib 7, unitary metal body 3, and ½ left wing 3C would all be flat and in the same plane. This broad surface can then be nailed to the side of any thickness rafter.

Another ½ long tie 22 could be placed on the opposite side of this rafter. The right trap 11 would face in the opposite direction to hold down a different sheet of sheathing. By incorporating two ½ long ties 22 on opposite sides of the same rafter, the resistance to uplift and lateral movement of the sheathing is increased tremendously.

FIG. 5A

Figure 5A:
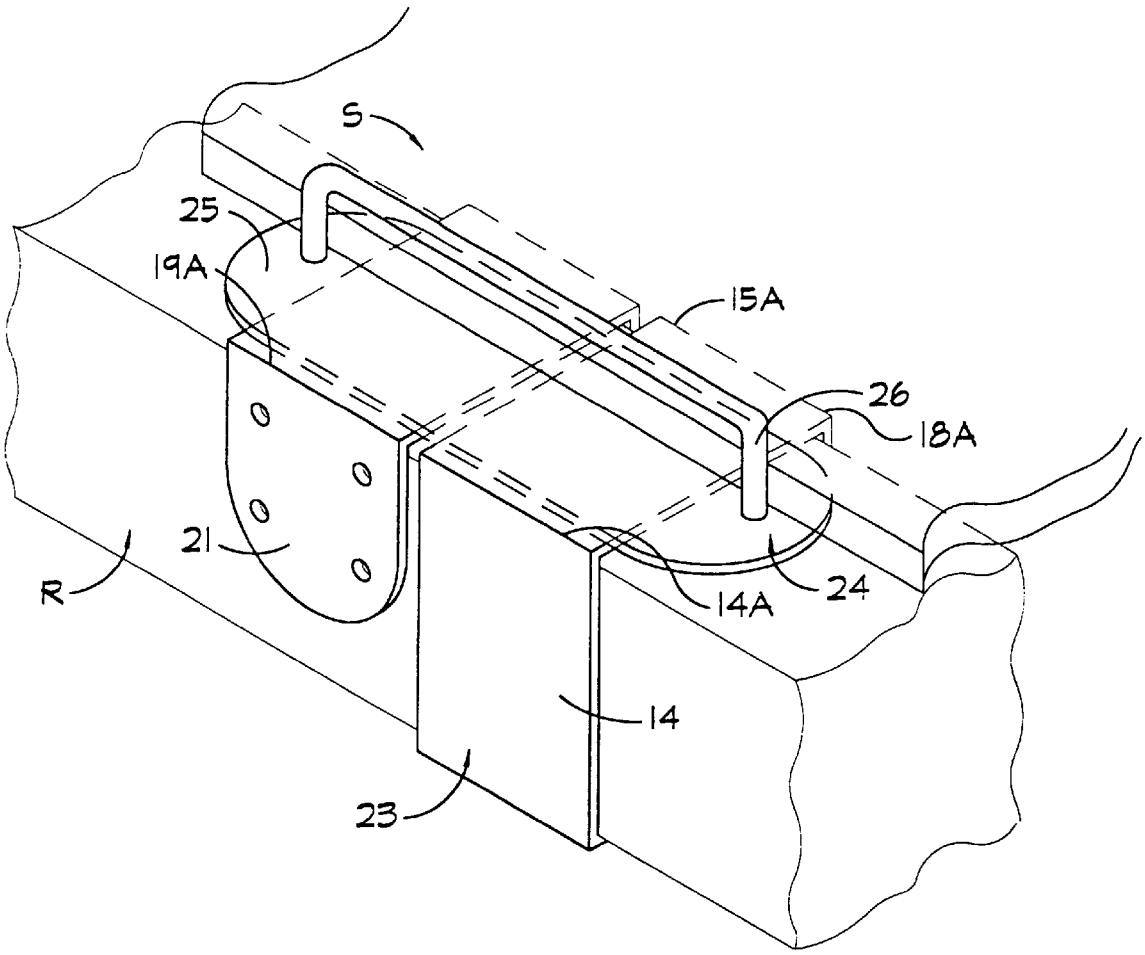
FIG. 5A is a perspective view of a wrap tie and wire lock.

Refer now to FIG. 5A which shows a perspective view of a wrap tie 23, an embodiment of an edge tie 2. The wrap tie 23 is very similar to an edge tie 2 except for the rung bends 16A and 17A. The left step bend 14A and right step bend 15A are the same as on the edge tie 2, but the left rung bend 16A and right rung bend 17A are not bent.

By not bending the rung bends 16A and 17A, this places the left grasp 20 and right grasp 21 facing down the sides of the rafter due to bends at the left ascent bend 18A and right ascent bend 19A.

Before the wrap tie 23 is installed on a rafter, a wire lock 24 is inserted underneath. The wrap tie 23 and wire lock 24 can be installed on a rafter prior to being placed on the roof, or the wrap tie 23 can be spread apart between the left grasp 20 and right grasp 21 by bending out at the left balanced bend 13A and right balanced bend 13B.

The wrap tie 23 is then wrapped around the rafter R, with the wire lock 24 inserted underneath, and the left grasp 20 and right grasp 21 nailed to the side of the rafter R. The wrap tie 23 and wire lock 24 are secured to the rafter R with slight movement allowable on the wire lock 24.

The wire lock 24 consists of a flat plate 25 with a stiff wire 26 attached. The thickness and shape of the wire 26 can be altered for different gaps between sheets of sheathing S. The height of the wire 26 is slightly higher than the sheathing S.

FIG. 5A shows a wrap tie 23 and wire lock 24 secured to a rafter R and a sheet of sheathing S slid next to the right side of the wire 26. The thickness of the wire 26 forms the gap, and the height is slightly above the sheathing S. The height above the sheathing is approximately equal to the thickness of a locking plate 27. For different thicknesses of sheathing, such as ⅝ or ¾ inch or metric, a different height of wire 26 could be used in the wire lock 24.

Another sheet of sheathing S would be inserted on the left, covering the wrap tie 23 and wire lock 24 with just the top and some of the side of the wire 26 exposed. With the sheathing laid down, a locking plate 27 (FIG. 5B) is installed and nailed down.

FIG. 5B

Figure 5B:
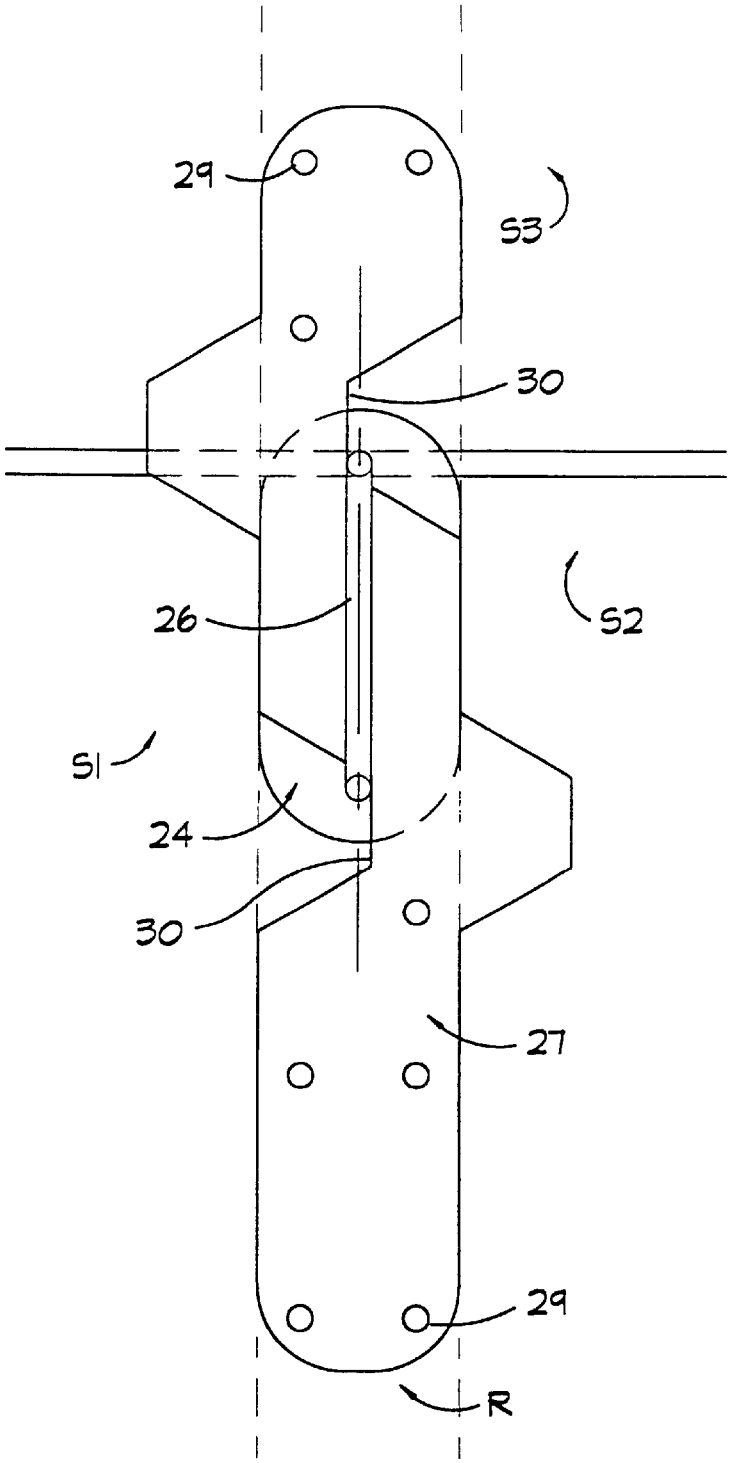
FIG. 5B is a top view of a sheathing lock.

Refer now to FIG. 5B which shows a top view of a locking plate 27 installed through the wire 26 of a wire lock 24. The locking plate 27 is secured to the sheathing S and underlying rafter R with nails through the accurately positioned nailholes 29. This locking plate 27 is holding down three sheets of sheathing S1, S2, and S3.

The locking plate 27 is a generally rectangular flat plate with stops 30 on opposite sides and the same distance apart as the width of the wire 26 on a wire lock 24.

With the wire 26 sticking up between sheets of sheathing S, the right end of the locking plate 27 is inserted through the wire 26 until the bottom stop 30 is against the wire 26. The left part of the locking plate 27 is then rotated clockwise until the top stop 30 is against the other side of the wire 26.

With the stops 30 against the wire 26, the nailholes 29 are positioned so they will be directly above the rafter R and ⅜ inch from the edges of the sheathing S. Nails or screws can then be used to fasten the locking plate 27 to the sheathing S and Rafter R.

FIG. 5B also shows a flat pattern layout of a locking plate 27 that would "nest" with each other, saving material and costs.

Figure 5C:
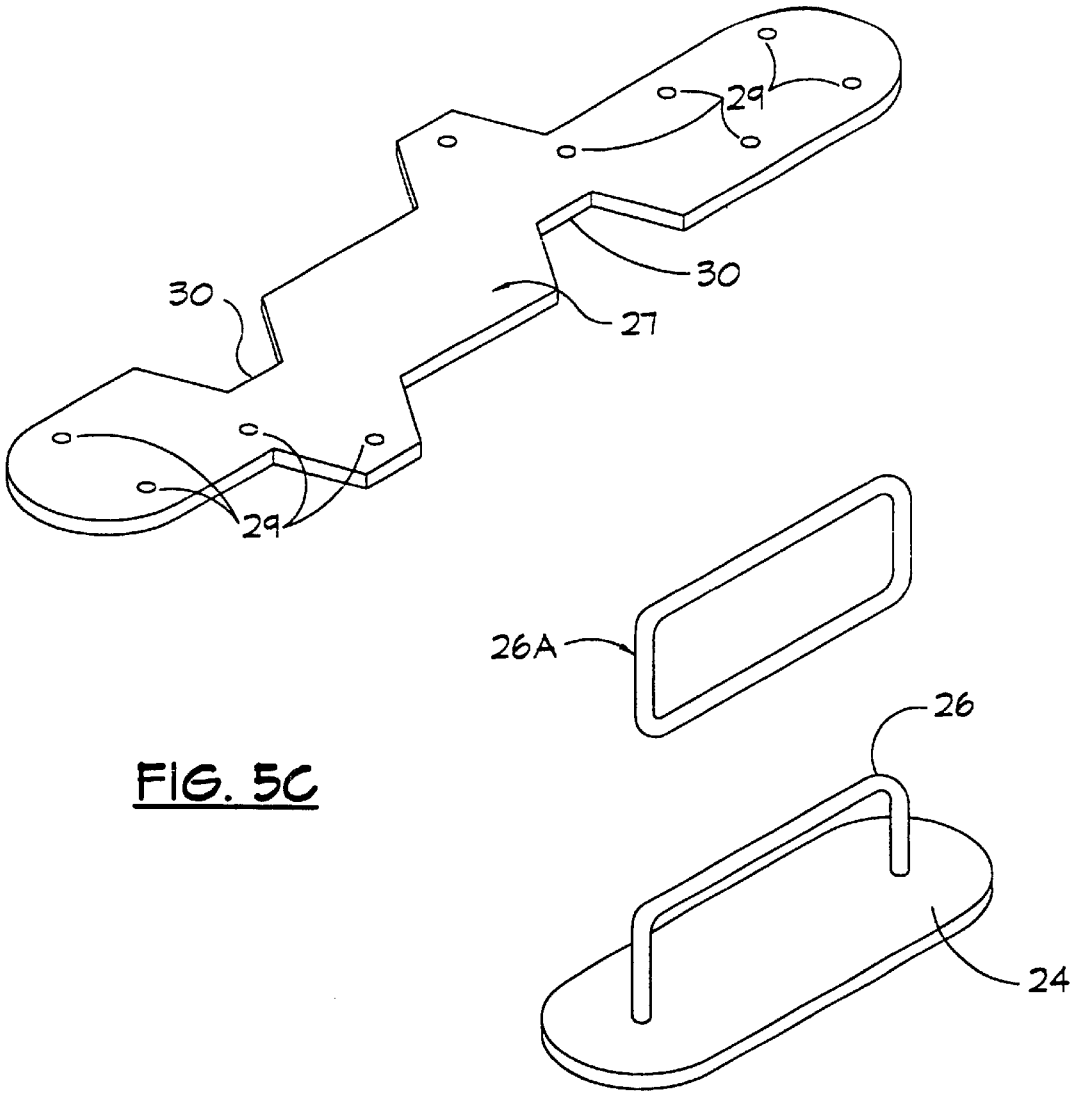
FIG. 5C is a perspective view of a sheathing lock.

FIG. 5C shows a perspective view of the locking plate 27 and wire lock 24.

FIG. 6

Figure 6:
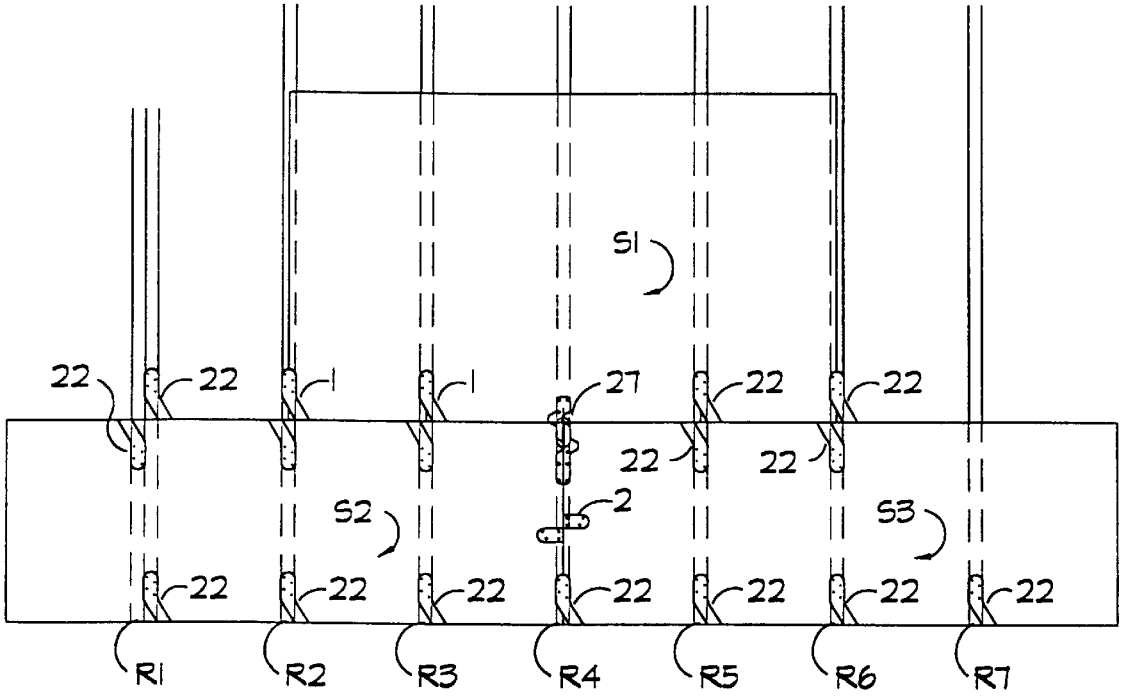
FIG. 6 shows locations of ties.

Refer now to FIG. 6 which shows a top view of sheathing being installed on a roof. The first row of sheathing sheets S2 and S3 were normal-sized 4×8 sheets that have been ripped down to 3×8 in order to get a reasonable width of sheathing on the last row. Along the leading edge, a critical edge that must be held down during a hurricane, ½ long ties 22 are shown attached to the sheathing S and underlying rafter R.

The rafters R are spaced 24 inches-on-center. Rafter R1 consists of a doubled-up 2×4. A ½ long tie 22 secures the leading edge of the sheathing S2, and at the trailing edge, another ½ long tie 22 secures that edge. Another ½ long tie 22 is installed on the rafter R1 for the next sheet of sheathing to be installed.

Rafter R2 consists of one 2×4. A ½ long tie 22 secures the leading edge of the sheathing S2, and at the trailing edge, the left part of a long tie 1 secures that edge. The right part of that long tie 1 is securing the edge of sheathing S1.

Rafter R3 consists of one 2×4. A ½ long tie 22 secures the leading edge of the sheathing S2, and at the trailing edge, the left part of a long tie 1 secures that edge. The right part of that long tie 1 is securing sheathing S1.

Rafter R4 consists of one 2×4. A ½ long tie 22 secures the leading edge of sheathing sheets S2 and S3. Further up this rafter, an edge tie 2 secures and spaces the sheathing sheets S2 and S3 and nails over the rafter R4. At the trailing edge, a locking plate 27 secures that edge, and ties down three sheets of sheathing S1, S2, and S3.

Rafter R5 consists of a 2×8. A ½ long tie 22 secures the leading edge of the sheathing S3, and at the trailing edge, another ½ long tie 22 secures that edge. Another ½ long tie 22 is installed on the rafter R5 to secure sheathing sheet S1.

Rafter R6 consists of a 2×8. A ½ long tie 22 secures the leading edge of the sheathing S3, and at the trailing edge, another ½ long tie 22 secures that edge. Another ½ long tie 22 is installed on the rafter RS to secure the edge of sheathing sheet S1 and the next sheet to be slid in from the right.

Rafter R7 consists of a 2×8. A ½ long tie 22 secures the leading edge of the sheathing S3.

Measuring was not needed for the gap between the sheets at the long dimension (long ties 1), nor was any measurement needed for the ¾ inch sheathing overhang on to the long edge of the rafter (edge ties 2).

This assures that each sheet will be at the right location down the line. In the past, if one sheet was placed down incorrectly, all the following sheets would also be misinstalled.

FIG. 6 also can show how earthquake and hurricane forces act on a house. Forces pushing from the side would try and rock the building. Fortunately, the triangular shaped second offset 5 and second side rib 4 of a long tie 1 form gussets, that are very resistant to rotation and racking.

The right angle bend at the left traverse bend 4A forms perpendicular gussets at the second offset 5 and second side rib 4 of a long tie 1, that can absorb and deflect forces from several directions. Up and down forces would be absorbed and transmitted, as would side to side movements.

The ties would absorb and transfer forces much better than just nails or screws. Previous to this invention, when nails were driven into the sheathing and structural member, the nails worked independently to resist forces. With this connector, all the nails driven in the connector, sheathing, and structural member work together to resist forces.

FIG. 6 also shows how the sheathing behaves during hurricane and earthquake forces, and how all the ties counteract and absorb these forces. The ties prevent uplift of sheathing, when installed on a roof; and blow out of sheathing, when installed on a wall. But during a hurricane, wind acts on a building in other ways.

If FIG. 6 represents a roof, and the wind was blowing from the left, the force would try and lift and rack the roof. Hurricanes can last for eight hours or more. Under the constant wind gusts, nails holding down the sheathing can fatigue or the plywood can split and the sheathing will separate from the rafter. The ties, with their large surface area, will prevent fatigue from occurring. Winds coming from the bottom, would try and lift the roof, but the ties with their large surface and holding power will prevent uplift.

If FIG. 6 represents a wall, an earthquake tremor from below would transmit a force upward and side to side. This force would try and slide the sheathing over each other. The ties would prevent that from happening. Hence forming the wall into a shearwall.

If the earthquake sent a shaking force through the wall, the wall would try and rack or move side to side. Since the studs are securely fastened to each other using the wall sheathing and ties, the wall will remain standing. Earth tremors would also try and slide the sheathing over each other, but the ties would prevent it.

Figure 7:
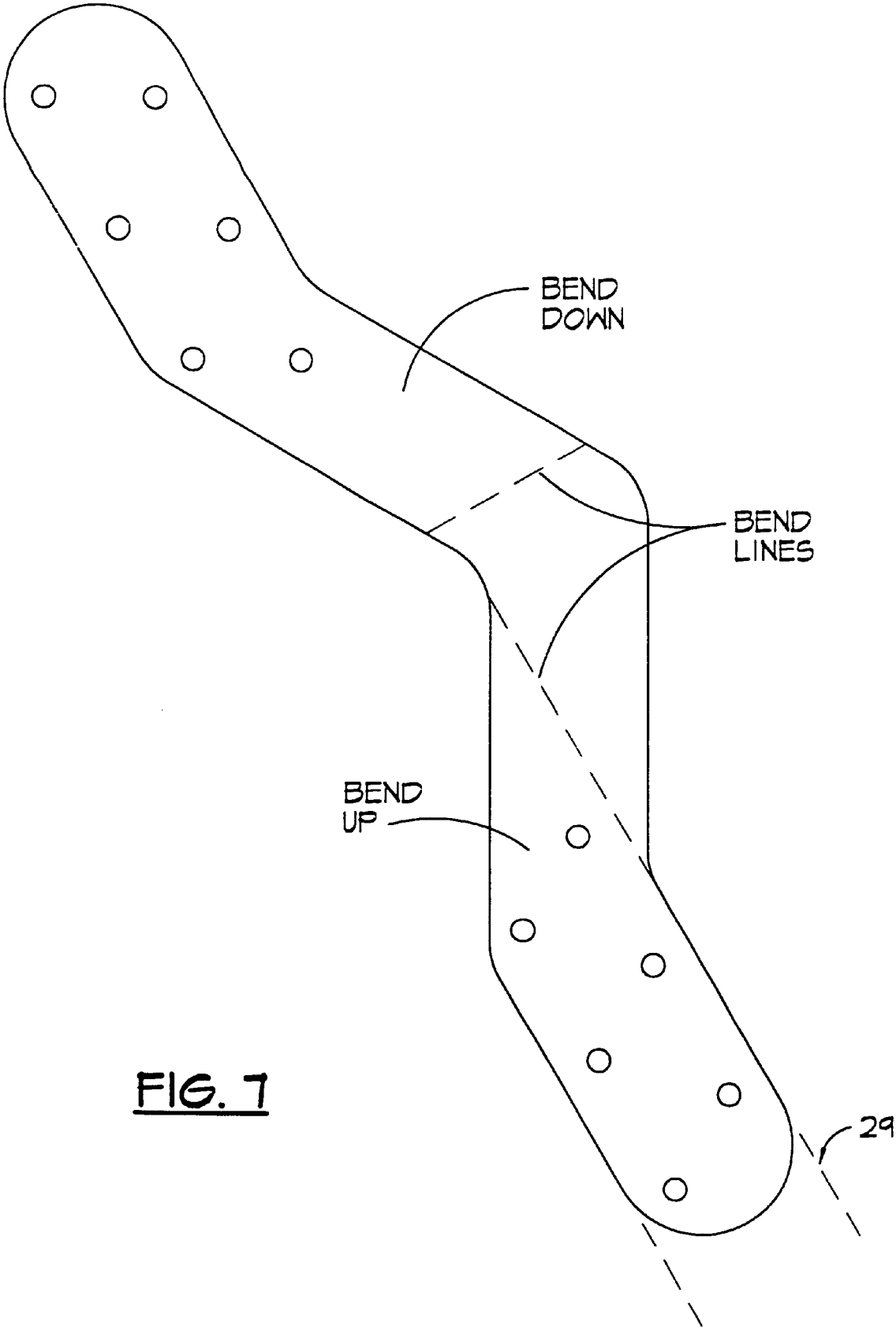
FIG. 7 is a flat pattern layout of an advanced sheathing tie.
Figure 8:
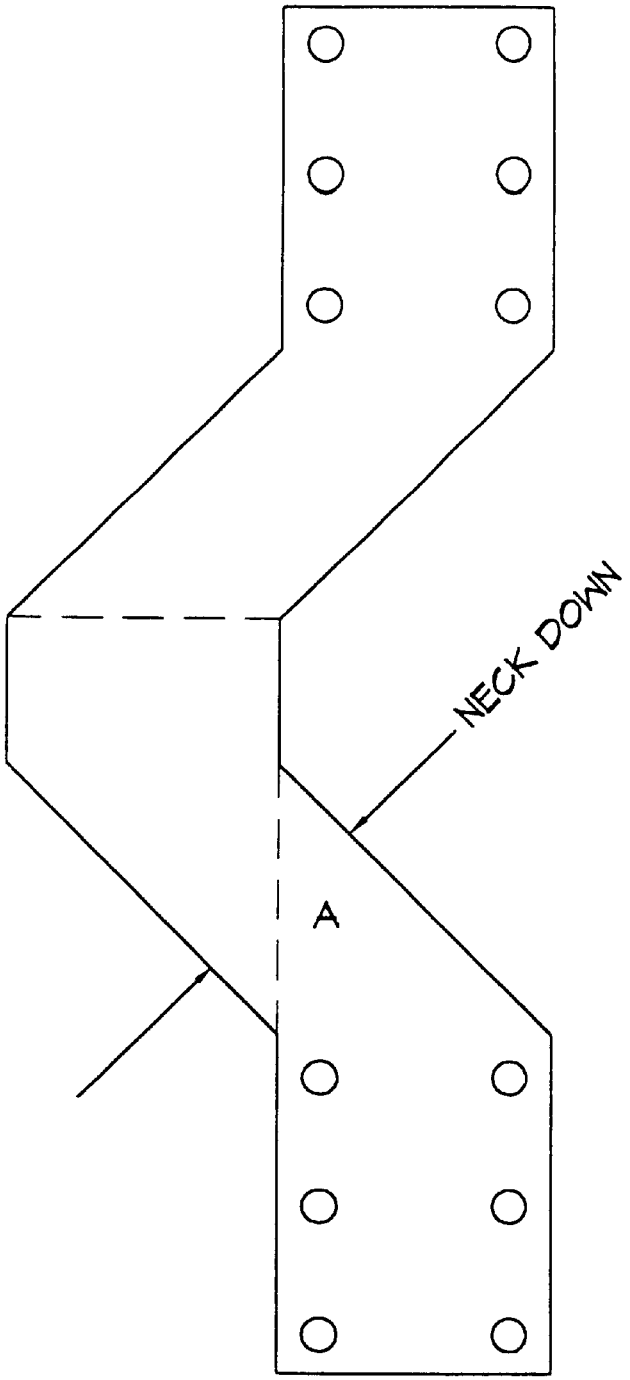
FIG. 8 is a flat pattern layout of prior art showing a neck down.

FIG. 7 shows a flat pattern layout of an advanced sheathing tie, an embodiment of a long tie 1.

CONCLUSION, RAMIFICATIONS, AND SCOPE

Thus, the reader will see that the sheathing tie of the invention provides a simple and economical connector that allows a builder to quickly, easily, and accurately secure weak parts of a building against earth tremors and high winds.

While my above description contains many specificities, these should not be construed as limitations on the scope of the invention, but rather as an exemplification of one preferred embodiment thereof. Many other variations are possible.

There can be minor variations in size, and materials. For example, the ties can have more rounded corners, squarer corners, wavy lines instead of straight lines, more nailholes, slightly less nailholes, or be thicker or thinner, wider or longer. The ties can be made for 2×4's and ¾ inch sheathing, or 2×6's with ⅝ inch sheathing or many other combinations of sheathing or beam size.

The ties can have different dimensions to fit the particular plans of the engineer and architect. In areas that have high winds or earthquakes, the ties could be thicker, wider, or have more nailholes. There could be more or less ties on each sheet, depending on the size of the sheet.

The ties can hold down boards instead of sheathing; they can also hold down insulated sheets or metal sheets. If the grasps 20 and 21 were formed with waves, they could hold down corrugated metal and fiberglass roofs. If the grasps were formed with hills and valleys, the ties could hold down pan deck (metal forms used to hold concrete for floors, on high rise buildings).

The ties can have a variety of shapes stamped in the grasp (20 and 21) or span (6 and 9) to hold down a variety of objects against sheathing.

The ties can have an underpass stamped in the grasp (20 and 21) or span (6 and 9) to hold down cable, wire, belts, or metal bands on top of the sheathing.

The ties can have tongues and groves stamped into the riser tabs (18 and 19) and the top of the tabs (5 and 8) for use on sheathing that has tongue and groove edges.

The ties can have a round unitary metal body and ribs (13, 14 and 15), or unitary metal body, ribs and offsets (3, 4, 5, 7, and 8), in order to fit around circular columns.

An edge tie 2 can have an increase in dimension at the left and right riser tabs 18 and 19 respectively, so that beams can be tied together on top of beams. Most structural beams are about twice as thick as sheathing. For example, 2× lumber is actually 1½ inches thick, and sheathing is ¾ inch thick. All the other dimensions can remain the same.

Where two beams come together, an edge tie 2 will tie them strongly together. Previously, beams were toenailed together, a weak connection. When two beams meet on top of a beam, wind and earthquake forces can lift or twist the beams.

On an edge tie 2, if the riser tabs 18 and 19 are as above, and the tread tabs 16 and 17 are elongated, approximately twice their distance, the tie can fasten one structural member on top of another, forming a T-beam. If another beam is fastened on the bottom it will form a strong I-beam. In instances where the rafters are warped, twisted, or bowed, the ties can help straighten them by securing the plywood down tightly with screws. On rough or un-planed boards, timbers, or beams, the ties, by wrapping around the timbers, form a secure connection to the sheathing.

The ties can be wrapped around different types of structural beams including wood, plastic, metal, concrete, or light-weight composite materials. The ties can hold down different types of sheathing including wood, glass, plastic, metal, concrete, slate, and mane-made materials.

The ties can be stamped as mirror images of the flat pattern layouts, for example, creating a tie with the ribs (14 and 15) on reversed sides, and angled saddle (13) facing to the left on FIG. 3A.

The ties can be made of metal by stamping, forging, or casting. The ties can be made of plastic, by molding or casting. The ties can be made of recycled materials. The ties can be made with bright colors, so a builder or inspector knows they are in position. They can be of different thicknesses, where the gap between each sheet has to be a specific distance.

Accordingly, the scope of the invention should be determined not by the embodiments illustrated, but by the appended claims and their legal equivalents.

What is claimed is:

1. An apparatus for preventing sheathing on a wood frame building from separating from underlying structural members during strong winds and earth tremors, comprising:

a. a unitary metal body being generally rectangular and flat;

b. a first side rib extending perpendicularly from one side of said body;

c. a second side rib extending perpendicularly from an opposing side of said body, wherein said first said side rib is parallel to said second side rib and adapted to be placed against opposing vertical sides of said structural member;

d. a first offset extending perpendicular to said first side rib;

e. a second offset extending perpendicular to said second side rib, wherein said first offset and said second offset extend away from said structural member in opposite directions;

f. a first span extending perpendicularly from said first offset and a first trap extending from said first span having a right angle bend along its length;

g. a second span extending perpendicularly from said second offset and a second trap extending from said second span having a right angle bend along its length, wherein said first span and said first trap, and said second span and said second trap are parallel to said body and pointing in opposite directions.

2. The apparatus of claim 1, wherein said unitary body, said first side rib, said second side rib, said first offset, said second offset, said first span, said second span, said first trap, and said second trap comprise a single piece of stamped sheet metal.

3. The apparatus of claim 2, wherein each of said traps includes a plurality of holes whereby fasteners are inserted to attach said first trap and said second trap to said sheathing.

4. The apparatus of claim 3, wherein each of said offsets includes a hole whereby fasteners are inserted to attach said first offset and said second offset to said structural member.

5. The apparatus of claim 3 or 4, wherein each of said side ribs includes a hole whereby fasteners are inserted to attach said first side rib and said second side rib to said structural member.

* * * * *